US011084243B2

(12) United States Patent
Giurlani

(10) Patent No.: US 11,084,243 B2
(45) Date of Patent: Aug. 10, 2021

(54) EMBOSSING SYSTEM

(71) Applicant: FUTURA S.P.A., Capannori (IT)

(72) Inventor: Giovacchino Giurlani, Capannori (IT)

(73) Assignee: FUTURA S.P.A., Capannori (IT)

( * ) Notice: Subject to any disclaimer, the term of this patent is extended or adjusted under 35 U.S.C. 154(b) by 267 days.

(21) Appl. No.: 16/462,269

(22) PCT Filed: Jan. 23, 2018

(86) PCT No.: PCT/IT2018/000008
§ 371 (c)(1),
(2) Date: May 20, 2019

(87) PCT Pub. No.: WO2018/142434
PCT Pub. Date: Aug. 9, 2018

(65) Prior Publication Data

US 2019/0322068 A1 Oct. 24, 2019

(30) Foreign Application Priority Data

Feb. 3, 2017 (IT) ..... 102017000011824

(51) Int. Cl.
*B31F 1/07* (2006.01)
*B31F 1/28* (2006.01)
*B31F 5/04* (2006.01)

(52) U.S. Cl.
CPC ..... *B31F 1/07* (2013.01); *B31F 1/2818* (2013.01); *B31F 5/04* (2013.01);
(Continued)

(58) Field of Classification Search
CPC ..... B31F 1/07; B31F 1/2818; B31F 1/2822; B31F 5/04; B31F 2201/0715;
(Continued)

(56) References Cited

U.S. PATENT DOCUMENTS 5,702,524 A * 12/1997 Finnicum ..... F16F 15/30 118/200
5,876,530 A * 3/1999 Seki ..... B31F 1/2831 156/64

(Continued)

FOREIGN PATENT DOCUMENTS

WO 2004096684 A2 11/2004

OTHER PUBLICATIONS

International Search Report dated May 3, 2018 and Written Opinion of corresponding application No. PCT/IT2018/000008; 9 pgs.

*Primary Examiner* — Hemant Desai
*Assistant Examiner* — Christopher Robin Kim
(74) *Attorney, Agent, or Firm* — Maier & Maier, PLLC

(57) ABSTRACT

An embossing system including: an embossing unit with at least one embossing roller arranged to emboss a web of paper intended to be joined with a further web by gluing; and a gluing unit associated with the embossing unit, with a tank containing the glue used to perform the gluing and a glue dispensing device including a cliche roller adapted to distribute by contact the glue contained in the tank on one of the webs while the embossing is performed, the cliche roller rotating with a pre-fixed angular velocity around an axis parallel to said at least one embossing roller. The system further includes: a sensor to produce electrical signals having amplitude and/or frequency related to the vibrations at which the cliche roll is instantaneously subject.

7 Claims, 2 Drawing Sheets

(52) U.S. Cl.
CPC ..... *B31F 2201/0715* (2013.01); *B31F 2201/0717* (2013.01); *B31F 2201/0764* (2013.01); *B31F 2201/0771* (2013.01); *B31F 2201/0779* (2013.01); *B31F 2201/0787* (2013.01)

(58) Field of Classification Search
CPC ..... B31F 2201/0717; B31F 2201/0771; B31F 2201/0774; B31F 221/0776; B31F 2201/0779; B31F 2201/0787; B31F 1/2831; Y10T 156/1016; Y10T 156/1722; Y10T 156/1798; B05C 11/02; B05C 1/083; B05C 1/0834
USPC ..... 493/13, 17, 30, 31, 58
See application file for complete search history.

(56) References Cited

U.S. PATENT DOCUMENTS

| | | | | |
|---|---|---|---|---|
| 6,470,294 | B1 | 10/2002 | Taylor | |
| 2001/0047850 | A1 | 12/2001 | Pallas et al. | |
| 2013/0260975 | A1* | 10/2013 | Ota | B31F 7/00 493/31 |
| 2015/0053330 | A1* | 2/2015 | Fischer | B32B 37/0076 156/176 |
| 2015/0059982 | A1* | 3/2015 | Hayashi | B31F 1/2863 156/361 |

* cited by examiner

EMBOSSING SYSTEM

The present invention relates to an embossing system.

FIELD

More particularly, the present invention relates to an embossing system in which glue is used to join together two or more webs of paper material to produce rolls of paper commonly called "logs" from which are obtained rolls of toilet paper, rolls of kitchen paper etc.

BACKGROUND

It is known that the production of logs of paper material, from which are obtained, for example, rolls of toilet paper or rolls of kitchen paper, implies the feeding of a web of paper, formed by one or more superimposed layers, on a predetermined path along which various operations are performed before proceeding to the formation of the logs, including a transversal pre-incision of the web to form pre-cut lines which divide it into separable tear-off sheets. The formation of logs implies the use of cardboard tubes, commonly called "cores" on the surface of which a predetermined amount of glue is distributed to allow the paper web to be bonded onto the cores gradually introduced into the machine which produces the logs, machine commonly called "rewinder". The formation of the logs also implies the use of winding rollers located at the cradle, which impose on each core to rotate about its longitudinal axis thus determining the winding of the web on the same core. One of the rollers is located below the cradle, while other rollers are placed above the cradle. The process ends when a predetermined number of sheets is wound on the core, with the gluing of a flap of the last sheet on the underlying sheet of the roll thus formed (so-called "closing flap" operation). Upon reaching the predetermined number of sheets wound on the core, the last sheet of the log being completed is separated from the first sheet of the next log, for example by a jet of compressed air directed towards a corresponding pre-cutting line. At this point, the log is downloaded from the rewinder. The patent EP1700805 describes a rewinding machine that operates according to the above operating scheme.

The paper web used by the rewinding machine can be made up of several plies which are previously embossed and joined together by gluing in a unit comprising a predetermined number of embossing rollers to which is associated a gluing unit for distributing glue on at least one of the plies subjected to embossing. In general, the gluing unit comprises an anilox roller which picks up the glue from a special intake tank and a cliché roller which receives by contact the glue from the anilox roller and distributes it onto the veil to be glued. If the glue in the tank is insufficient or does not distribute correctly on the anilox roller, the contact between the latter and the cliché roller (the rollers in question rotate different speeds) causes overheating which, in particular, can damage the cliché roller.

SUMMARY

The systems based on the temperature control of the cliché roller are inadequate because they are delayed since the detection of overheating occurs when this phenomenon has already occurred.

The main object of the present invention is to propose an embossing/gluing system provided with a particularly rapid and efficient control mechanism.

This result has been achieved, in accordance with the present invention, by adopting the idea of implementing a system having the characteristics indicated in claim 1. Other features of the present invention are the subject of the dependent claims.

In accordance with the present invention, provision is made to compare the vibrations of the cliché roller during operation with a reference model previously formed in a testing phase of the unit in which the cliché roller is installed, having observed that the vibrations of said component may vary according to the amount of glue actually present on its surface. The reference model can be constructed by running the embosser in different regimes, i.e. under conditions of correct and respectively incorrect distribution of the glue on the cliché roller, detecting its vibrations. During operation of the system, a sensor device detects the vibrations of the cliché roller and produces corresponding electrical signals which, converted into numerical data, are used by a control unit which compares them with the data detected and recorded in the reference model. If the instantaneous values detected during the use of the system differ from the previously acquired reference values, the control unit generates an electrical alarm signal that can be used to drive an acoustic and/or luminous signal and/or to control the stop of the plant or the slowing down of the units that form the plant itself until the correct operating conditions are restored. In the construction phase of the reference model, a sensor device is used, preferably the same device subsequently used when the system is in operation, suitable for producing electrical signals of amplitude and frequency related to the vibrations of the system under test.

By detecting the vibrations of the cliché roller during operation and comparing them with the data of a previously acquired reference model, it is possible to check in real time whether the cliché roller is adequately lubricated by the glue or not and therefore intervene in extremely short times to restore the conditions of correct operation, so as to significantly reduce the risk that this expensive component of the plant is damaged by an insufficient or in any case incorrect distribution of the glue on its surface.

These and further advantages and characteristics of the present invention will be more and better understood by any person skilled in the art, thanks to the following description and to the attached drawings, provided as an example but not to be considered in a limiting sense, in which:

DETAILED DESCRIPTION

Figure 2:
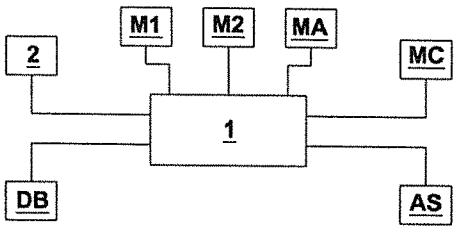
FIG. 2 represents a simplified block diagram of a system for controlling the operating unit shown in FIG. 1.
Figure 1:
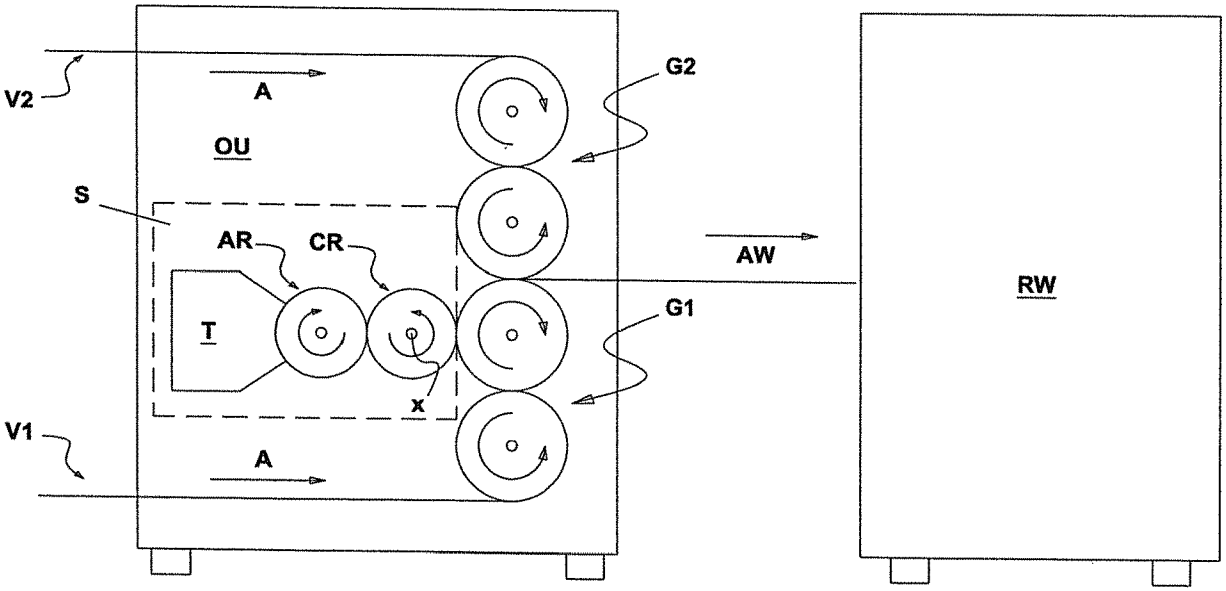
FIG. 1 schematically represents an operative unit for embossing and gluing two plies of paper material usable in a paper converting plant according to the present invention.

The operating unit (OU) schematically represented in FIG. 1 comprises a pair of embossing rollers with relative counter-rollers (G1, G2) arranged vertically overlapped, i.e. with the corresponding rotation axes horizontally oriented and aligned along the same vertical axis. The unit (OU) also comprises a glue distributor with a tank (T), an anilox roller (AR) and a cliché roller (CR) whose axes are parallel to those of the embossing rollers. The tank (T) contains the glue used to glue together two plies of paper material (V1, V2) supplied by respective reels placed on unwinders (not shown in the drawings) arranged upstream of the unit (UO) with respect to the direction (A) from which the same plies (V1, V2) come. The latters, passing between the embossing rollers and the relative counter-rollers (G1, G2), are embossed. The anilox roller (AR), rotating around its own axis, picks up the glue from the tank (T) and transfers it to the cliché roller (CR) which, in turn, distributes it on the ply (V1) subjected to embossing by the respective roller and counter-roller (G1). The ply (V1) will therefore stick to the ply (V2) treated by the roller and by the counter-roller (G2) forming the web (W) that comes out of the unit (OU) along the direction (AW) to feed a rewinder (RW), prepared downstream, which wind the web (W) to produce logs destined to be cut transversely to obtain rolls of toilet paper, kitchen paper etc. In general, the cliché roller and the anilox roller have different rotation speeds to allow the glue to be dosed differently depending on the product to be produced. The structure and operation of such an operating unit are known to those skilled in the art. The structure and operation of the rewinders as well as the structure and operation of the unwinders are also known. Alternatively, according to a scheme also known to those skilled in the art, in the unit (OU) a ply (V2) is not embossed. In this case, the roller and the counter-roller of the couple (G2) form a guide device for the ply (V2) which remains smooth and is glued to the ply (V1) which is instead embossed. Normally, the gluing unit (T, AR, CR) is positioned on a respective support structure (S) which allows it to be placed in operative position (set-up in which the cliché roller CR is coupled to an embossing roller) and in inoperative position (set-up in which the cliché roller CR is spaced from the embossing roller to which it is instead approached in the operating phase).

According to the present invention, the aforesaid operating unit (OU) is controlled by a programmable control unit (1) which controls the motors (M1, M2) which determine the rotation of the embossing rollers and of the relative counter-rollers (G1, G2), the motors (MA, MC) of the anilox (AR) and cliché (CR) rollers, and the actuator (AS) which determines the movement of the mobile support (S) of the gluing unit (T, AR, CR). A sensor (2) able to detect the vibrations of the cliché roller (CR) is connected to a corresponding input of the control unit (1). For example, said sensor (2) is an accelerometer of the SKF CMSS2200 type. For example, this sensor (2) detects the vibrations of a bearing supporting one end of the cliché roller (CR) shaft in such a way as to detect the vibrations of the shaft itself. The sensor (2) produces electrical signals representative of the vibrations to which the cliché roller (CR) is subjected during its operation. In other words, the electrical signals produced by the sensor (2) are signals of amplitude and frequency determined by the vibrations of the cliché roller (CR).

In a step of carrying out the control system object of the present invention, the operating unit (OU) is operated under normal conditions (i.e. under conditions of proper lubrication of the cliché roller CR which receives glue from the anilox roller AR in sufficient quantity to guarantee lubrication), and in conditions of poor lubrication (i.e. in conditions of insufficient lubrication of the cliché roller CR which receives glue from the anilox roller AR in insufficient quantity to guarantee a correct lubrication), detecting the vibrations of the cliché roller (CR) in each of these operating conditions specially reproduced. Preferably, said vibrations are detected with the same sensor (2) subsequently used during operation of the system. Said measurements, i.e. the amplitude and/or frequency of the signals produced by the sensor used to detect the vibrations of the cliché roller (CR), are recorded in a data file (DB) which is used by the control unit (1) as further indicated below. For example, the file (DB) can be registered in a memory section of the control unit (1). In practice, during the formation of the file (DB), both normal and abnormal operating conditions of the unit (OU) are reproduced and data of amplitude and/or frequency of electrical signals produced by the vibrations of the cliché roller (CR) are recorded by a transducer that converts such vibrations into electrical signals. The data thus recorded are then used as a reference model in the phase of actual productive use of the operational unit (OU). In fact, during operation of the unit (OU), the control unit (1) continuously receives the data corresponding to the signals produced by the sensor (2) and compares them with the data of the file (DB). If the data related to the vibrations detected by the sensor (2) correspond to the data of the file (DB) representing anomalous operating conditions, the control unit (1) intervenes on the motors (M1, M2, MA, MC) to slow down the rotation of the rollers connected to them or also to stop the rotation thereof. In the latter case, the control unit (1) can also be programmed to drive the actuator (AS) so as to distance the gluing unit (T, AR, CR) from the embossing rollers.

Figure 3:
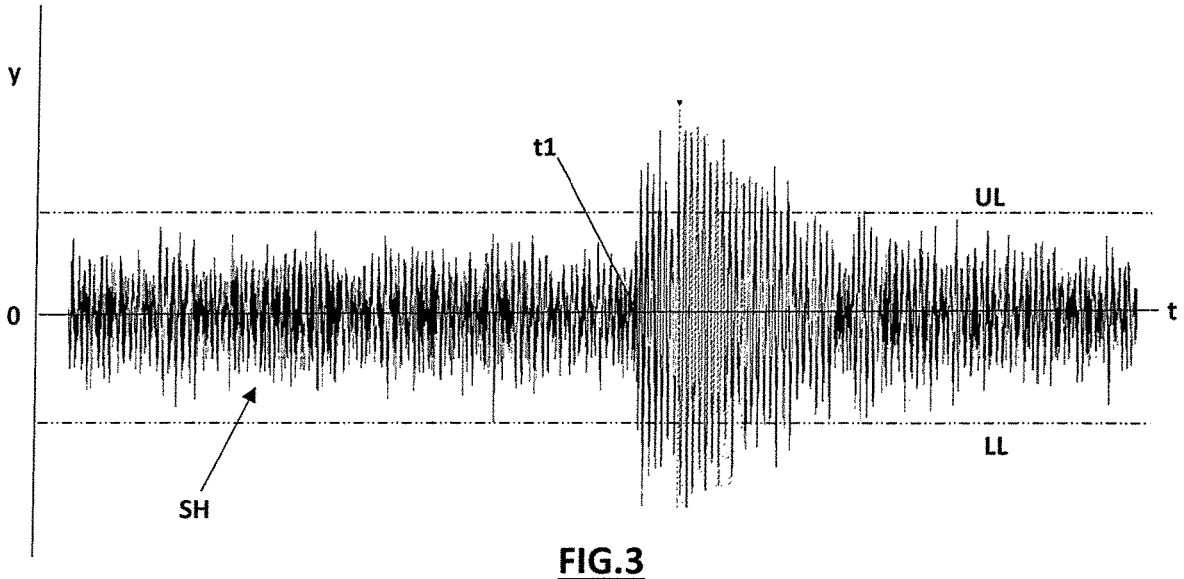
FIGS. 3 and 4 schematically represent a possible time course of the amplitude of the signal produced by the sensor (2)

FIG. 3 schematically represents the time course of the electrical signal (SH) produced by the sensor (2) during operation (operational use phase) of the unit (OU). The dotted lines (UL, LL) represent the upper (UL) and lower (LL) limits of a field within which the amplitude (y) of the signal (SH) may vary over time (t) without the unit of control (1) generate any alarm signal. The values (UL, LL) are determined in the testing phase of the unit (OU) and represent two limit values of the signal amplitude (SH) detected in conditions of correct lubrication of the cliché roller (CR). In the example shown in FIG. 3, at time t1 the signal amplitude (SH) is outside the field (UL-LL). Therefore, at time t1, the control unit (1) generates the alarm signal which determines the activation of the programmed procedure (slowing down or stopping the system).

Figure 4:
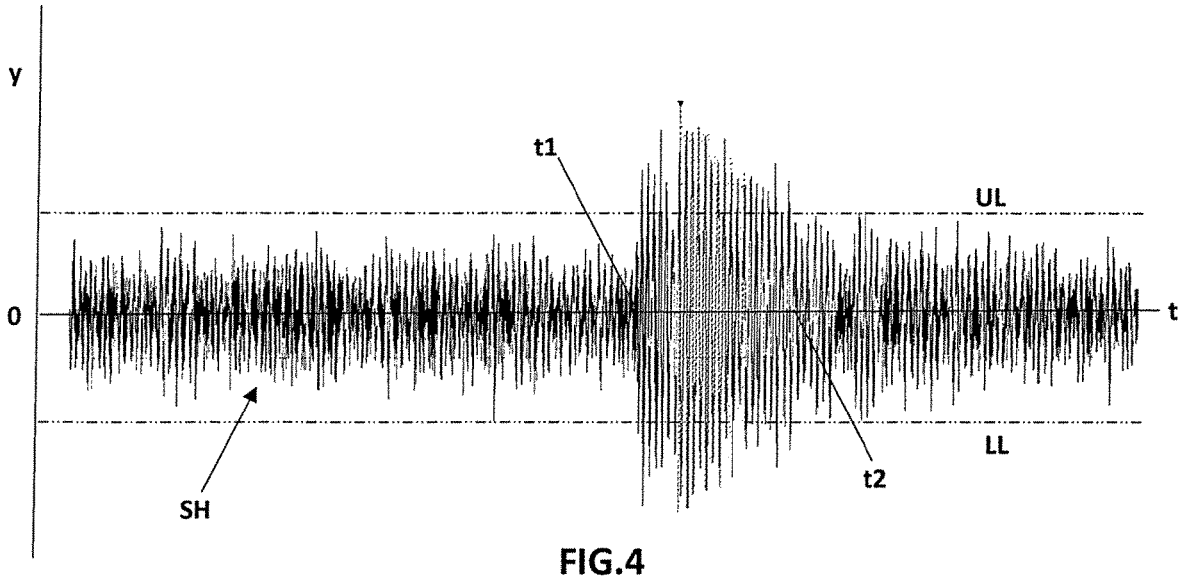

Alternatively, with reference to FIG. 4, the control unit (1) can be programmed to generate said alarm signal if the signal trend (SH) is such that the limit values (UL, LL) are exceeded for a predetermined number (N) of times in a time interval (ΔT) also pre-established. In the example of FIG. 4 the signal (SH) is outside the limits (UL, LL) for more than 20 times in the time interval $\Delta t = t2 - t1$. If $\Delta t \geq \Delta T$ and the preset value for the number (N) is equal to 20, then the control unit (1) generates the alarm signal that determines the activation of the programmed procedure (slowing down or stopping the system).

Figure 5:
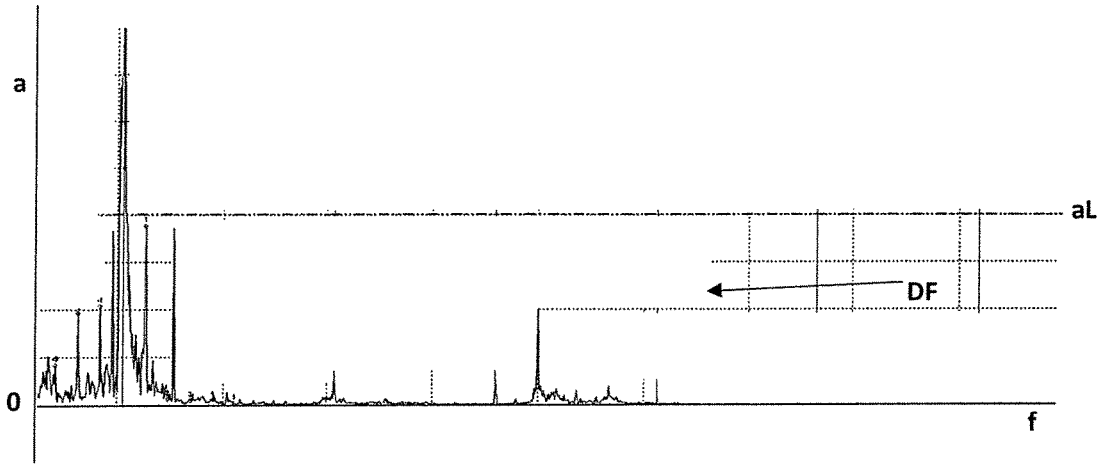
FIG. 5 schematically represents the signal produced by the sensor (2) in the frequency domain.

FIG. 5 schematically represents the instantaneous values (a) of the signal produced by the sensor (2) as a function of the frequencies (f). In this graph a possible distribution (DF) is qualitatively shown, showing a limit value (aL) assumed as reference for the control unit (1), similarly to what previously stated with reference to the amplitude data of the signal produced by the sensor (2).

From the foregoing description it is evident that an embossing system according to the present invention comprises:

an embossing unit with at least one embossing roller (G1; G2) arranged to emboss a web of paper (V1; V2) intended to be joined with a further web (V2, V1) by gluing;

a gluing unit associated with the embossing unit, with a tank (T) containing the glue used to perform said gluing and a glue dispensing device (GD) comprising a cliché roller (CR) adapted to distribute by contact the glue contained in the tank (T) on one of said webs (V1, V2) while the embossing is performed, said cliché roller (CR) rotating with a pre-fixed angular velocity around an axis (x) parallel to said at least one embossing roller (G1; G2);

a sensor (2) apt to produce electrical signals having amplitude and/or frequency related to the vibrations at whom said cliché roll (CR) is instantaneously subject, while the same rotates around said axis (x);

a control unit (1) that receives instantaneous data of the amplitude and/or frequency of the signals produced by said sensor (2) and compares them with reference data contained in a file (DB) previously acquired by testing the embossing unit and the gluing unit in conditions of regular and respectively non-regular distribution of the glue on the cliché roller (CR), said reference data being constituted by a first set of amplitude and/or frequency data representative of normal vibrations and a second set of amplitude and/or frequency data representative of abnormal vibrations respectively, the control unit (1) being programmed to generate an alarm signal if at least an instantaneous datum of amplitude and/or frequency of the signals produced by said sensor (2) corresponds to at least a datum of amplitude and/or frequency of the second set.

In practice, the details of execution may in any case vary in an equivalent manner as regards the individual elements described and illustrated, without departing from the scope of the solution idea adopted and therefore remaining within the limits of the protection conferred by the following claims.

The invention claimed is:

1. An embossing system comprising:

an embossing unit with at least one embossing roller arranged to emboss a web of paper intended to be joined with a further web by gluing; and a gluing unit associated with the embossing unit, with a tank containing glue used to perform said gluing and a glue dispensing device comprising a cliche roller adapted to distribute by contact the glue contained in the tank on one of said webs while the embossing is performed, said cliche roller rotating with a pre-fixed angular velocity around an axis parallel to said at least one embossing roller; and further comprising:

a sensor to produce electrical signals having amplitude and/or frequency related to the vibrations at which said cliche roller is instantaneously subject, while the cliche roller rotates around said axis;

a control unit that during operation of the embossing system receives instantaneous data of the amplitude and/or frequency of signals produced by said sensor and compares them with reference data contained in a file previously acquired by testing the embossing unit and the gluing unit in conditions of regular and respectively non-regular distribution of the glue on the cliche roller, said reference data comprising a first set of amplitude and/or frequency data representative of normal vibrations and a second set of amplitude and/or frequency data representative of abnormal vibrations respectively, the control unit being programmed to generate an alarm signal if at least an instantaneous datum of amplitude and/or frequency of the signals produced by said sensor corresponds to at least a datum of amplitude and/or frequency of the second set.

2. An embossing system according to claim 1, wherein the data of the first and second set of data are acquired by means of the sensor which produces the instantaneous data in an operating phase of the embossing system.

3. An embossing system according to claim 1, wherein said sensor detects the vibrations of a shaft of the cliche roller, and the axis of the cliche roller coincides with said axis of rotation.

4. An embossing system according to claim 1, wherein said alarm signal activates a procedure of slowing or stopping of the embossing system controlled by the control unit.

5. An embossing system according to claim 1, wherein the cliche roller and the embossing rollers are driven by respective drive units, and said alarm signal activates a procedure of slowing or stopping of said drive units controlled by the control unit.

6. An embossing system according to claim 1, wherein the gluing unit is mounted on a relative support which allows the removal of the gluing unit from the embossing unit by means of an actuator, and said alarm signal activates the actuator so determining said removal.

7. An embossing system according to claim 1, wherein the control unit generates said alarm signal if the instantaneous data of amplitude and/or frequency of the signals produced by the sensor correspond to the data of the second set for a predetermined number of times in an interval of time which is also predetermined.

* * * * *